US006218991B1

(12) United States Patent
Sanad

(10) Patent No.: US 6,218,991 B1
(45) Date of Patent: Apr. 17, 2001

(54) COMPACT PLANAR INVERTED F ANTENNA

(76) Inventor: Mohamed Sanad, 5830 Lindsay Dr., Reno, NV (US) 89523

( * ) Notice: Subject to any disclaimer, the term of this patent is extended or adjusted under 35 U.S.C. 154(b) by 0 days.

(21) Appl. No.: 09/648,276

(22) Filed: Aug. 25, 2000

Related U.S. Application Data

(60) Provisional application No. 60/151,274, filed on Aug. 27, 1999.

(51) Int. Cl.[7] ..... H01Q 1/38

(52) U.S. Cl. ..... 343/700 MS; 343/831; 343/846

(58) Field of Search ..... 343/700 MS, 702, 343/846, 848, 829, 830, 831; H01Q 1/38

(56) References Cited

U.S. PATENT DOCUMENTS

| | | | |
|---|---|---|---|
| 4,783,661 | 11/1988 | Smith . | |
| 5,526,003 | 6/1996 | Ogawa et al. . | |
| 5,568,155 | 10/1996 | Tsunekawa et al. . | |
| 5,644,319 | 7/1997 | Chen et al. . | |
| 5,703,600 | 12/1997 | Burrell et al. . | |
| 5,764,190 | 6/1998 | Murch et al. . | |
| 5,828,340 | 10/1998 | Johnson . | |
| 5,952,975 | 9/1999 | Pedersen et al. . | |
| 5,986,606 | 11/1999 | Kossiavas et al. . | |
| 6,002,367 | 12/1999 | Engblom et al. . | |
| 6,005,520 | 12/1999 | Nalbandian et al. . | |
| 6,005,524 | 12/1999 | Hayes et al. . | |
| 6,005,525 | 12/1999 | Kivela . | |
| 6,008,764 | 12/1999 | Ollikainen et al. . | |
| 6,072,434 | 6/2000 | Papatheodorou . | |
| 6,140,969 | * 10/2000 | Lindenmeier et al. | 343/700 MS |

* cited by examiner

*Primary Examiner*—Hoanganh Le
(74) *Attorney, Agent, or Firm*—Ancel W. Lewis, Jr.

(57) ABSTRACT

A compact planar inverted F antenna suited for remote wireless metering includes a circuit element, a ground plane and a feed probe. The circuit element has a planar portion with a reactance window, and a narrowed tab that extends transverse to the planar portion and is connected to the ground plane. The reactance window and narrowed tab reduce the size of the circuit element. The feed probe is connected between the circuit element and the ground plane. The ground plane has conductive portions that are wrapped around a substrate to reduce the physical size of the ground plane. The length of the tab and thereby the distance between the planar portion and the ground plane is selected so that the feed probe is a radiating element. The antenna is compact with good isotropic characteristics and sensitivity to two perpendicular polarizations.

7 Claims, 3 Drawing Sheets

COMPACT PLANAR INVERTED F ANTENNA

This application claims the benefit under 35 U.S.C. § 119(e) of the U.S. provisional patent application Ser. No. 60/151,274 filed Aug. 27, 1999.

TECHNICAL FIELD

The present invention relates to antennas and more particularly to a compact isotropic planar inverted F antenna.

BACKGROUND ART

Planar inverted F antennas generally include at least one planar radiating element and a ground plane in a plane parallel to the radiating element. A short tab at one end of the radiating element that extends transverse to the radiating element is connected to the ground plane. A coaxial cable extends through the ground plane at a selected location and the center pin of the coaxial cable is connected to the radiating element. This type of antenna is called an inverted F antenna because the side profile is shaped like the letter F with the radiating element forming the long portion, the tab forming top transverse leg and the center pin of the coaxial cable forming the other transverse leg. In prior known planar inverted F antennas, the radiating element is located relatively near the ground plane so that the length of the tab is less than 10% of the length of the radiating element.

Planar inverted F antennas are used in wireless communications. As the number of wireless applications increases and the physical size of wireless devices decreases, antennas for these applications and devices are needed. Prior known planar inverted F antennas have been limited by the required size of the radiating element, the required size of the ground plane, limited bandwidth and limited isotropic characteristics.

DISCLOSURE OF THE INVENTION

A compact planar inverted F antenna having a circuit element and a ground plane is disclosed. The circuit element is conductive sheet, preferably brass, and includes a planar portion with a tab. The tab is narrower than the planar portion and extends perpendicular to the plane of the planar portion from a first edge. The length of the tab is about 25% and greater of the length of the planar portion. The planar portion has a reactance window extending inward from an edge that is adjacent to the first edge. The ground plane includes a substrate, a conductive planar first portion on a first side of the substrate, and conductive planar second and third portions on a second side of the substrate. The second and third portions are connected to the first portion through vias near a first end of the substrate and near a second end opposite the first end, respectively. The second and third portions are separated by a gap extending across the substrate parallel to the first end. The tab of the circuit element is soldered to the first portion of the ground plane. A feed pro is soldered to the circuit element and to a plated pad on the first portion of the ground plane.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
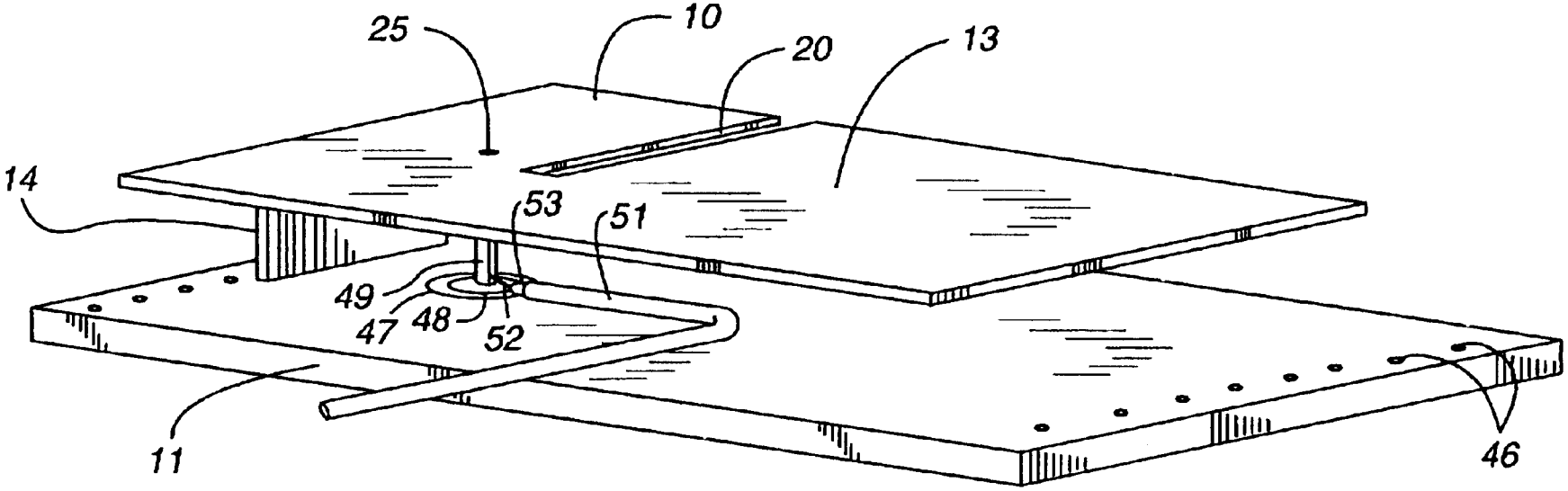
FIG. 1 is a perspective view of an antenna embodying features of the present invention.
Figure 2:
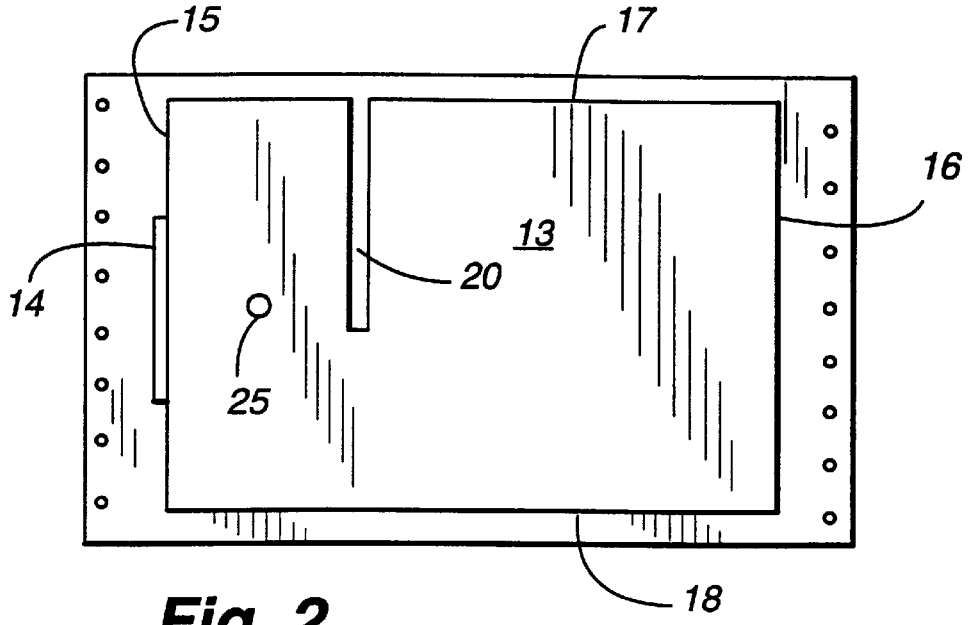
FIG. 2 is a top plan view of the antenna of FIG. 1.
Figure 3:
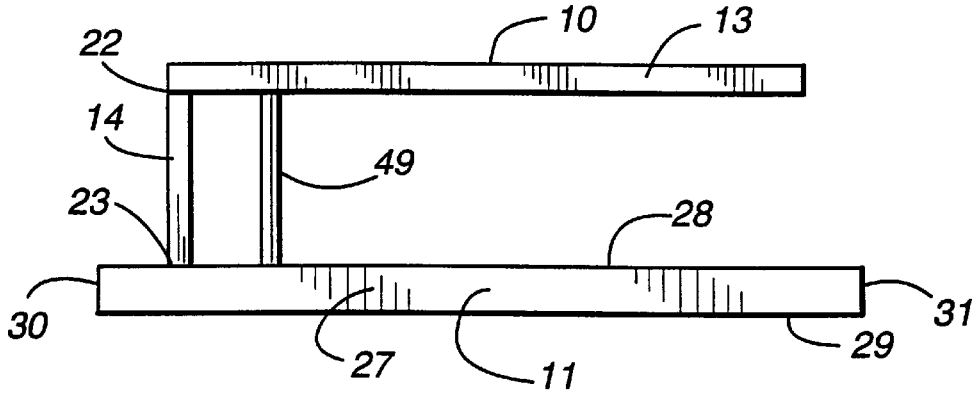
FIG. 3 is a side elevation view of the antenna of FIG. 1.
Figure 4:
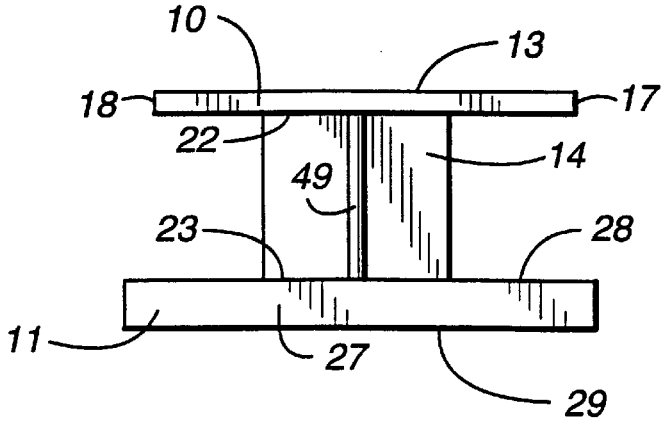
FIG. 4 is an end elevation view of the antenna of FIG. 1.
Figure 5:
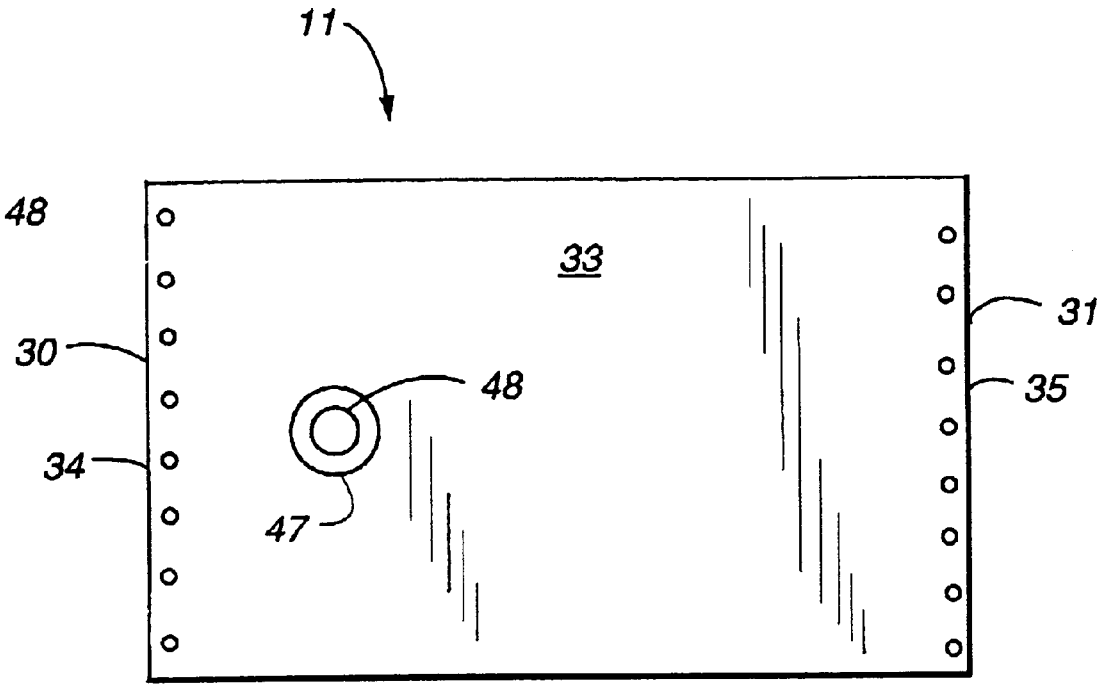
FIG. 5 is a top plan view of the ground plane of the antenna of FIG. 1.
Figure 6:
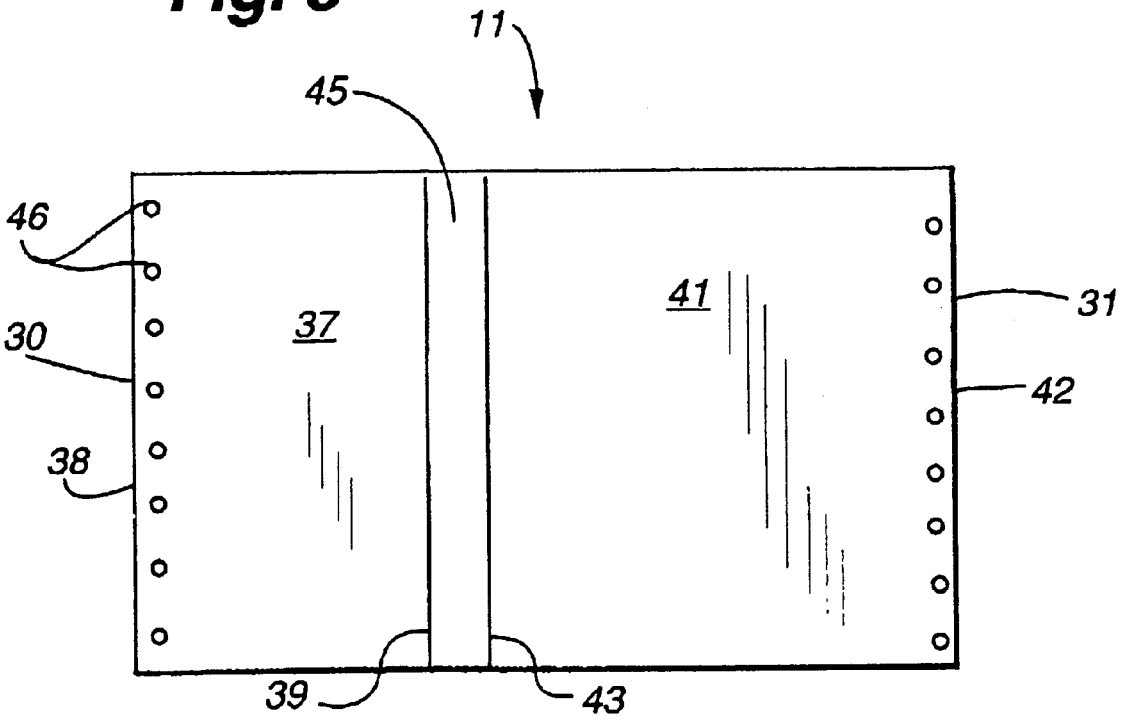
FIG. 6 is a bottom plan view of the ground plane of the antenna of FIG. 1.

Referring now to FIG. 1, the compact planar inverted F antenna embodying features of the present invention includes a circuit element 10 and a ground plane 11. The circuit element has a planar portion 13 which is the main radiating element and a tab 14. The planar portion 13 is generally rectangular with a first edge 15, a spaced second edge 16 opposite the first edge 15, and spaced, opposed third and fourth edges 17 and 18 extending between and transverse to the first and second edges 15 and 16.

The planar portion 13 also has a reactance window 20. The reactance window 20 is generally rectangular and extends inward from third edge 17 towards fourth edge 18 parallel to and spaced a selected distance from the first edge 15. The tab 14 is rectangular with a first edge 22 that is connected to the first edge 15 of the planar portion 13 and a spaced second edge 23 opposite the first edge 22. Preferably the tab 14 has a length from the first edge 22 to the second edge 23 that is equal or greater than 25% of the length of the planar portion 13 from the first edge 15 to the second edge 16. The tab 14 extends in a plane transverse or perpendicular to the plane of the planar portion 13 and the tab 14 is narrower than the first edge 15 of the planar portion 13. The tab 14 is shown midway between the third edge 17 and the fourth edge 18, however the tab 14 may be located at any position along the first edge 15. An aperture 25 is located in the planar portion 13 intermediate the first edge 15 and the reactance window 20 and intermediate the third and fourth edges 17 and 18.

The ground plane 11 includes a substrate 27 that is generally rectangular with a planar first side 28 and a spaced second side 29 opposite the first side 28, and a first end 30 and a spaced second end 31 opposite the first end 30. A conductive first portion 33 is attached to and substantially covers the first side 28 of the substrate 27, and has a first end 34 adjacent to the first end 30 of the substrate 27 and a second end 35 adjacent to the second end 31 of the substrate 27. Conductive second and third portions 37 and 41 are attached to the second side 29 of the substrate 27. The conductive second portion 37 has a first end 38 adjacent to the first end 30 of the substrate 27 and extends inward on second side 29 of substrate 27 to a spaced second end 39 opposite the first end 38. The third conductive portion 41 has a first end 42 adjacent to the second end 31 of the substrate 27 and extends inward on second side 29 of substrate 27 to a spaced second end 43 opposite the first end 42. The second end 39 of the second portion 37 and the second end 43 of the third portion are separated on the second side 29 of the substrate 27 by a uniform gap 45.

The first portion 33 is conductively connected to the second portion 37 with plated through holes or vias 46 that extend through substrate 27 near the first end 30 of substrate 27. The first portion 33 is conductively connected to the third portion 41 with plated through holes or vias 46 that extend through substrate 27 near the second end 31 of substrate 27. The ground plane 11 is preferably made with a copper clad or copper covered suitable substrate such as FR4 with the gap 45 etched or otherwise removed from the second side 29 of the substrate. The conductive first, second and third portions 33, 37 and 41 are essentially folded or wrapped around the substrate. 27 and effectively provide a ground plane almost twice the size of the first portion 33 but occupying only the space of the first portion 33.

The second edge 23 of the tab 14 of the circuit element 10 is attached to the first portion 33 of the ground plane 11, spaced from and substantially parallel with the first end 34 of the first portion, such that the planar portion 13 of the circuit element 10 is spaced from and in substantially parallel alignment over the ground plane 11. The first portion 33 of the ground plane 11 includes an opening 47 generally aligned with the aperture 25 in the planar portion 13 of the circuit element 10. A plated pad 48 is located inside the opening 47 with clearance around the pad 48 so that the pad 48 is electrically isolated from the first portion 33. A feed probe 49 is attached, preferably by soldering, between the pad 48 and the aperture 25. A coaxial cable 51 is attached with the center pin 52 of the coaxial cable 51 being connected to feed probe 49 near pad 48 and the shield cover 53 of the coaxial cable 51 being connected to the first portion 33 of the ground plane 11 adjacent to the opening 47. Alternatively, the center pin 52 of the coaxial cable 51 can be attached directly to the aperture 25, the shield cover 53 of the coaxial cable 51 can be attached to the first portion 33 of the ground plane 11 and the opening 47, the pad 48 and the feed probe 49 can be eliminated.

The circuit element 10 is partially shorted to the ground plane 11 by the tab 14 that is narrower than the first edge 15 of the planar portion 13, which reduces the required size of the antenna. The reactance window 20 reduces the required size of the antenna. The reactance window 20 also increases the amount of diffracted wave, thereby improving the isotropic characteristics and making the antenna sensitive to two perpendicular polarizations. Multiple tabs or reactance windows could be provided. The length of the tab 14 and feed probe 49, and therefore the depth of the antenna, are greater than in prior known planar inverted F antennas. Prior known planar inverted F antennas have a tab length and feed probe length of less than 10% the radiating element length whereas the antenna of the present invention has a tab length and feed probe length of more than 25% the radiating element length. This longer feed probe 49 is a significant radiating element, further improving the isotropic characteristics. The first, second and third portions 33, 37 and 41 of the ground plane 11, connected as described, provide a compact ground plane that is electrically large enough to avoid lowering efficiency.

By way of example and not of limitation, an antenna embodying features of the present invention, designed for use with Global System for Mobile Communications (GSM) systems for frequencies in the range of about 890 to 960 MHz would be dimensioned as follows. The circuit element 10 is made from brass sheet with an exemplary thickness of 0.375 mm (0.015"). The planar portion 13 has a length of 54 mm from the first edge 15 to the second edge 16 and a width of 36 mm from the third edge 17 to the fourth edge 18. The reactance window 20 extends 20 mm inward from the third edge 17 of the planar portion 13, is 2 mm wide and spaced 16 mm from the first edge 15. The tab 14 has a length of 14 mm from the first edge 22 to the second edge 23 and a width of 16 mm. The aperture 25 is centered between the third and fourth edges 17 and 18 of the planar portion 13, is spaced 8 mm from the first edge 15 and is about 1.25 mm (0.050") in diameter.

The ground plane 11 is made from 1.0 mm (0.040") thick FR4 with 2 oz. copper on each side. The ground plane 11 has a length of 68 mm from the first end 30 to the second end 31 of the substrate 27 and a width of 40 mm and the first portion 33 has these same dimensions. The second portion 37 of the ground plane 11 has a length of 28 mm, the third portion 41 of the ground plane 11 has a length of 36 mm and the gap 45 is 4 mm. The vias 46 are nominally 0.75 mm (0.030") is diameter. The pad 48 is 2.5 mm (0.100") in diameter and the center of the pad 48 is spaced 12 mm from the first end 30 of the substrate 27. The opening 47 has about 6 mm clearance from the pad 48. The second edge 23 of the tab 14 of the circuit element 10 is spaced 4 mm from the first end 30 of the substrate 27.

The antenna described is particularly suited for installation in normally unfriendly RF environments. The antenna has been found to work well within an enclosure. Examples include wireless metering applications such as vending machines and meter boxes. The antenna is also suitable as an internal antenna for portable telephone handsets.

Although the present invention has been described with a certain degree of particularity, it is understood that the present disclosure has been made by way of example and that changes in details of structure may be made without departing from the spirit thereof.

What is claimed is:

1. A compact planar inverted F antenna comprising:

a conductive circuit element including a planar portion and a tab extending transverse said planar portion, said planar portion having a first edge and a second edge spaced a selected first distance from said first edge, said tab having a first edge and a second edge spaced a selected second distance from said first edge, said second distance being at least 25% of said first distance, said first edge of said tab being connected to said first edge of said planar portion, and a ground plane including planar conductive first, second and third portions,each having a first end and a spaced second end opposite said first end, said second and third portions being co-planar with said second ends of said second and third portions being opposite each other and separated by a gap, said second and third portions being spaced from and aligned with said first portion with said first end of said second portion being conductively connected to said first end of said first portion and said first end of said third portion being conductively connected to said second end of said first portion, said second edge of said tab of said circuit element being connected to said first portion of said ground plane opposite said second and third portions, with said planar portion being aligned over and spaced at said second distance from said first portion of said ground plane.

2. The antenna of claim 1 wherein said first edge of said planar portion has a selected first width and said tab has a selected second width that is less than said first width.

3. The antenna of claim 1 wherein said planar portion includes a third edge between said first and second edges and a fourth edge opposite said third edge, and said planar portion includes a reactance window extending inward from said third edge toward said fourth edge.

4. The antenna of claim 1 including a feed probe, said ground plane having a pad coplanar with and electrically isolated from said first portion and said feed probe being connected to said planar portion of said circuit element, extending transverse therefrom and being connected to said pad.

5. The antenna of claim 1 wherein said ground plane includes a dielectric substrate having a first side and a second side with said first portion of said ground plane being attached to said first side and said second and third portion being attached to said second side.

6. The antenna of claim 5 wherein said second and third portions of said ground plane are connected to first portion by vias extending through said substrate.

7. A compact planar inverted F antenna comprising:

a conductive circuit element including a planar portion and a tab each having a first edge and a spaced second edge opposite said first edge, said first edge of said tab being connected to said first edge of said planar portion with said tab extending transverse to said planar portion, said first edge of said planar portion having a selected first width and said tab having a selected second width that is less than said first width, said planar portion having a third edge between said first and second edges and a fourth edge opposite said third edge, said planar portion including a reactance window extending inward from said third edge toward said fourth edge, a ground plane including a planar dielectric substrate, and conductive first, second and third portions each having a first end and a spaced second end opposite said first end, said substrate having a first and second side with said first portion being attached to said first side and said second and third portions being attached to said second side with said second ends of said second and third portions being opposite each other and separated by a gap, said first end of said second portion being conductively connected to said first end of said first portion through vias extending through said substrate and said first end of said third portion being conductively connected to said second end of said first portion through vias extending through said substrate, said second edge of said tab of said circuit element being connected to said first portion of said ground plane opposite said second and third portions, said second edge of said tab being spaced from said first end of said first portion with said planar portion aligned with said first portion of said ground plane and spaced from said first portion of said ground plane by a selected uniform distance that is at 25% the length of said planar portion from said first edge to said second edge, said ground plane including an opening in said first portion and a pad on said first side of said substrate within said opening, and a feed probe connected to said planar portion of said circuit element intermediate said first edge and said reactance window and intermediate said third and fourth edges, said feed probe extending transverse to said planar portion of said circuit element and being connected to said pad on said ground plane.

* * * * *